US009234687B2

(12) United States Patent
Lee

(10) Patent No.: US 9,234,687 B2
(45) Date of Patent: Jan. 12, 2016

(54) REFRIGERATOR

(71) Applicant: LG ELECTRONICS INC., Seoul (KR)

(72) Inventor: Seunggeun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 314 days.

(21) Appl. No.: 13/937,916

(22) Filed: Jul. 9, 2013

(65) Prior Publication Data

US 2014/0013792 A1 Jan. 16, 2014

(30) Foreign Application Priority Data

Jul. 10, 2012 (KR) ..... 10-2012-0074868

(51) Int. Cl.

| | |
|---|---|
| ***F25D 3/02*** | (2006.01) |
| ***F25C 1/00*** | (2006.01) |
| ***F25C 5/18*** | (2006.01) |
| ***F25D 23/02*** | (2006.01) |
| ***F25D 23/04*** | (2006.01) |

(52) U.S. Cl.

CPC . *F25C 1/00* (2013.01); *F25C 5/182* (2013.01); *F25D 23/025* (2013.01); *F25D 23/04* (2013.01); *F25C 2400/10* (2013.01); *F25C 2500/08* (2013.01); *F25D 2317/061* (2013.01); *F25D 2400/06* (2013.01)

(58) Field of Classification Search

CPC .... F24F 5/0017; F25C 5/005; F25C 2400/10; F25D 17/045

USPC ..... 62/186, 187, 344, 408, 411, 412, 414, 62/425, 426

See application file for complete search history.

(56) References Cited

U.S. PATENT DOCUMENTS

| | | | | |
|---|---|---|---|---|
| 7,654,105 | B2 * | 2/2010 | Lee et al. | 62/344 |
| 2006/0179869 | A1 | 8/2006 | Lee et al. | |
| 2006/0213214 | A1 * | 9/2006 | Choi | 62/352 |
| 2007/0119202 | A1 | 5/2007 | Kadowaki et al. | |
| 2008/0034780 | A1 * | 2/2008 | Lim et al. | 62/353 |
| 2008/0223069 | A1 * | 9/2008 | Hsu | 62/344 |
| 2008/0236187 | A1 | 10/2008 | Kim | |
| 2008/0264082 | A1 * | 10/2008 | Tikhonov et al. | 62/137 |
| 2008/0295539 | A1 * | 12/2008 | An et al. | 62/407 |
| 2009/0145157 | A1 | 6/2009 | Jeong et al. | |
| 2010/0269533 | A1 * | 10/2010 | Hwang | 62/344 |

FOREIGN PATENT DOCUMENTS

| | | | |
|---|---|---|---|
| CN | 101650105 | A | 2/2010 |
| DE | 102008024499 | A1 | 12/2008 |
| JP | 11-304319 | A | 11/1999 |
| KR | 10-0809749 | B1 | 3/2008 |
| KR | 10-2009-0060045 | A | 6/2009 |
| KR | 10-2011-0045386 | A | 5/2011 |

* cited by examiner

*Primary Examiner* — Melvin Jones

(74) *Attorney, Agent, or Firm* — Birch, Stewart, Kolasch & Birch, LLP

(57) ABSTRACT

A refrigerator is provided. The refrigerator includes a main body including a compartment, an ice bank configured to store ice cubes, an ice maker configured to generate ice cubes and to move the ice cubes to the ice bank, the ice maker including an ice tray, a cover configured to isolate the ice bank and the ice maker from the compartment, the cover including a first opening and an ice shutter configured to prevent cold air flowing through the first opening of the cover into the ice maker from being introduced into the ice bank.

21 Claims, 9 Drawing Sheets

REFRIGERATOR

CROSS-REFERENCE TO RELATED APPLICATION

This application claims priority to Korean Patent Application No. 10-2012-0074868 filed on Jul. 10, 2012, the disclosure of which is incorporated by reference herein in its entirety.

BACKGROUND OF THE INVENTION

1. Field of the Invention

The present invention is directed to a refrigerator, and more specifically, to an apparatus that prevents ice cubes from sticking to each other in an ice tray of a refrigerator having an ice making apparatus.

2. Description of Related Art

A refrigerator is a box-shaped appliance for storing food at a low temperature to keep the food fresh. Home refrigerators also may include a freezing apparatus for freezing water or food. A home refrigerator generally relies on vapor compression using a motor and a compressor installed in a sealed container to provide cooling and freezing, particularly, as a liquid coolant flows from the compressor through an expansion valve to an evaporator such that cooling is performed.

As life styles have changed, refrigerators have grown bigger so that they may retain more food. So-called "side-by-side" type refrigerators having both a refrigerating compartment and a freezing compartment laterally separated from each other have gained popularity for home refrigerators. Further, refrigerators have developed a diversity of functions and designs.

Generally, a refrigerator may have an ice making apparatus for making ice and a dispenser through which cool water or ice may be dispensed to the outside without requiring a user to open the doors of the refrigerator. The ice making apparatus stores ice cubes made by an ice maker in an ice bank that is a container for retaining the ice cubes, and as manipulated by a user, sends the ice cubes stored in the ice bank to the dispenser through an ice chute. To be able to provide ice cubes whenever a user desires, the ice bank is filled with lots of ice cubes. Heat exchange may occur due to a difference in temperature between ambient air and the ice cubes or air flowing in from the outside, causing the ice cubes to stick to each other. Suck sticking phenomenon hinders the ice cubes from being down to the dispenser through the ice chute.

In particular, when cold air supplied to the ice maker for ice making flows in the ice bank through a path for conveying ice cubes made in the ice maker, ice cubes stored in the ice bank may be more prone to stick together.

BRIEF SUMMARY OF THE INVENTION

The present invention has been conceived considering the problem identified above, and an object of the present invention is to prevent sticking of ice cubes that often occurs in an ice making apparatus of a refrigerator. A more particular object of the present invention is to provide an apparatus that prevents cold air supplied to the ice maker for ice making from flowing into the ice bank.

To achieve the above objects, a refrigerator includes an ice bank for storing ice cubes, an ice maker for generating ice cubes in an ice tray using flowing cold air and dropping the ice cubes to the ice bank, a cover for isolating the ice bank and the ice maker from a freezing compartment or a refrigerating compartment, and an ice shutter for preventing cold air flowing through a first opening formed at the cover into the ice maker from being introduced into the ice bank.

In an embodiment, only when the ice cubes generated in the ice maker are carried to the ice bank, the ice shutter may be rotated and opened by the carried ice cubes.

In an embodiment, the ice shutter may include a shutter upper portion formed of injection-molded plastic and a shutter lower portion formed of silicone.

In an embodiment, part of the shutter lower portion may be cut in a vertical direction.

In an embodiment, the ice shutter may further include a shutter side portion that extends in a vertical direction from an upper part of the cover at an opposite side of a header having a motor therein to rotate an ejector for separating ice cubes from the ice tray.

In an embodiment, the shutter side portion may be formed of injection-molded plastic, and wherein the shutter side portion forms a flat surface in a direction perpendicular to a flat surface formed by the shutter upper portion and the shutter lower portion.

In an embodiment, the ice shutter may be connected to a lower surface of an upper part of the cover through a shutter rotational shaft and rotates about the shutter rotational axis.

In an embodiment, the first opening, the shutter rotational shaft, and a front portion of the ice tray may be further away from a front surface of the cover in an order thereof.

In an embodiment, the ice shutter may have a width corresponding to a horizontal length of the ice tray.

In an embodiment, the ice shutter may have a vertical length that extends so that a lower end thereof hangs over a front portion of the ice tray.

In an embodiment, the first opening may be formed at an upper surface of the cover, and a second opening may be formed at a side surface of the cover to discharge cold air flowing through the first opening.

In an embodiment, the second opening may be formed at a side surface of an opposite side of a header having a motor therein to rotate an ejector for separating ice cubes from the ice tray.

In an embodiment, the second opening may be formed at a side further away from a front surface of the cover with respect to a front and rear direction at the side surface.

In an embodiment, one or more ribs may be protruded from a lower surface of the upper part of the cover to correspond in position and shape to parts of the ice maker that may be placed under the cover.

In an embodiment, one or more guiding ribs may be formed at an upper surface of the upper part of the cover to guide cold air discharged from a cold air hole of the refrigerating compartment or freezing compartment to be introduced into the first opening.

In an embodiment, right before and when the ice cubes generated in the ice maker are carried to the ice ban, a cooling fan for supplying cold air through the first opening may stop operation.

In an embodiment, the ice maker, the ice bank, the cover, and the ice shutter may be mounted at a door of the refrigerator.

In an embodiment, the refrigerator may further include a dispenser positioned at a front surface of the door to discharge ice cubes from the ice bank to an outside.

Accordingly, according to the present invention, ice cubes may be prevented from sticking to each other in a container that retains a lot of ice cubes.

Further, the capability of ice making of the ice making apparatus may be enhanced.

BRIEF DESCRIPTION OF THE DRAWINGS

The embodiments of the present invention will become readily apparent by reference to the following detailed description when considered in conjunction with the accompanying drawings wherein.

DETAILED DESCRIPTION OF THE INVENTION

Hereinafter, exemplary embodiments of a refrigerator according to the present invention will be described in greater detail with reference to the accompanying drawings.

In a refrigerator having a dispenser to supply ice cubes to a user through the dispenser, the dispenser should be connected to an ice making apparatus for making ice. If the refrigerator has the ice making apparatus in a freezing compartment, ice cubes may be provided through a connection path to the dispenser located in a freezing compartment door; however, in such an arrangement, the connection path and the ice making apparatus take up too much space in the freezing compartment, thus resulting in a lowering in space efficiency.

In light of the foregoing, commercially available refrigerators may be provided with an ice making apparatus and a dispenser at the refrigerating compartment or freezing compartment door. In the case of a French-type refrigerator having a freezing compartment at a lower part while having a refrigerating compartment at an upper part, the refrigerator may include, for users' convenience, an ice making apparatus and a dispenser at a left refrigerating compartment door. However, since the freezing compartment is higher in temperature as compared with the ice making apparatus, ice making efficiency is reduced, ice production is slow, and sticking of ice cubes are prone to occur as the ice cubes stored in the container melt. Further, such French-type refrigerators have other restrictions on being made bulky.

In contrast to a French-type refrigerator, a side-by-side type refrigerator having a refrigerating compartment and a freezing compartment laterally separated from each other, which may be more advantageous because they can be made larger, may have an ice making apparatus and a dispenser installed at a door of the freezing compartment so that cold air from the freezing compartment may be directly fed to the ice making apparatus. Accordingly, ice cubes may be more efficiently made, stored, and transported to the dispenser.

Figure 1:
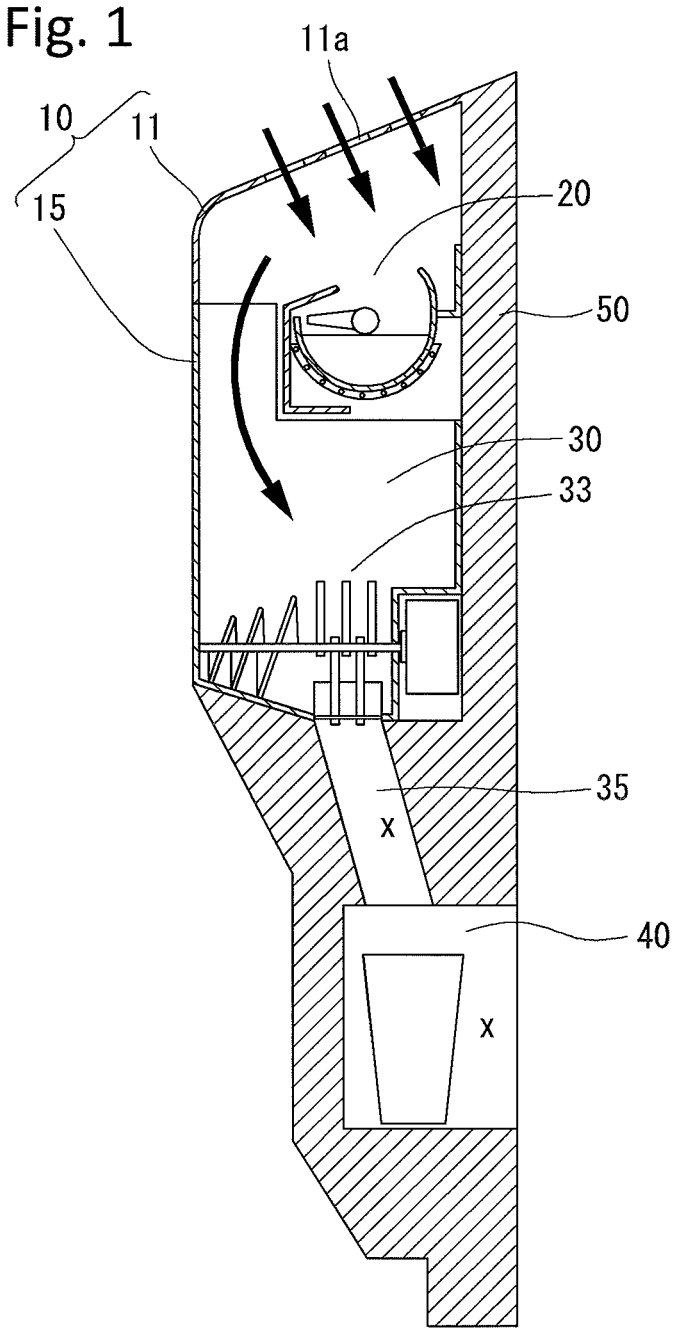
FIG. 1 is a vertical cross sectional view schematically illustrating an ice making apparatus mounted at a door of a conventional refrigerator.

FIG. 1 is a vertical cross sectional view schematically illustrating an ice making apparatus mounted at a door of a conventional refrigerator. As seen in FIG. 1, the ice making apparatus may include a cover 10 for blocking heat between the refrigerating compartment or freezing compartment and the ice making apparatus, an ice maker 20 for making ice cubes, an ice bank 30 for storing ice cubes that are made and dropped from the ice maker 20, and an ice conveying/crushing means 33 for conveying ice cubes or breaking ice cubes into pieces. The ice cubes stored in the ice bank 30 are discharged by the ice conveying/crushing means 33 and then pass through an ice chute 35 down to the dispenser 40. As seen in FIG. 1, a door 50 may be the door of the refrigerating compartment or freezing compartment.

The cover 10 may include an upper cover 11 for covering an upper part of the ice making apparatus and a front cover 15 for covering a front side of the ice making apparatus. The upper cover 11 has a plurality of openings 11*a* for passing cold air therethrough. The cold air is supplied from a cold air hole located at an upper part of the refrigerating compartment or freezing compartment.

Cold air may be supplied through an opening 11*a* of the upper cover 11 and passes through the ice maker 20 to the ice bank 30, the upper part of which is open. The ice maker 20 is arranged to provide a structure for dropping ice cubes down to the ice bank 30 through a path between the ice maker 20 and the front cover 15. Since cold air supplied to the ice maker 20 to make the ice cubes also reaches the ice bank 30 through a path necessary for dropping the ice cubes, the ice cubes stored in the ice bank 30 may stick to each other and may deteriorate the capability of the ice making of the ice maker 20. For example, the ice cubes contained in the ice bank 30 are sublimated and exchange heat with ambient air so that the ice cubes stick to each other. Such sticking of the ice cubes occurs more frequently when cold air flows into the ice cubes from the outside. Further, when ice cubes are separated from each other in the ice maker 20, the ice cubes may be heated by a heater and, as a result, water may be left on the surface of ice cubes dropping to the ice bank 30. Thus, cold air supplied to the ice bank 30 may cause the ice cubes to stick to each other.

Figure 2:
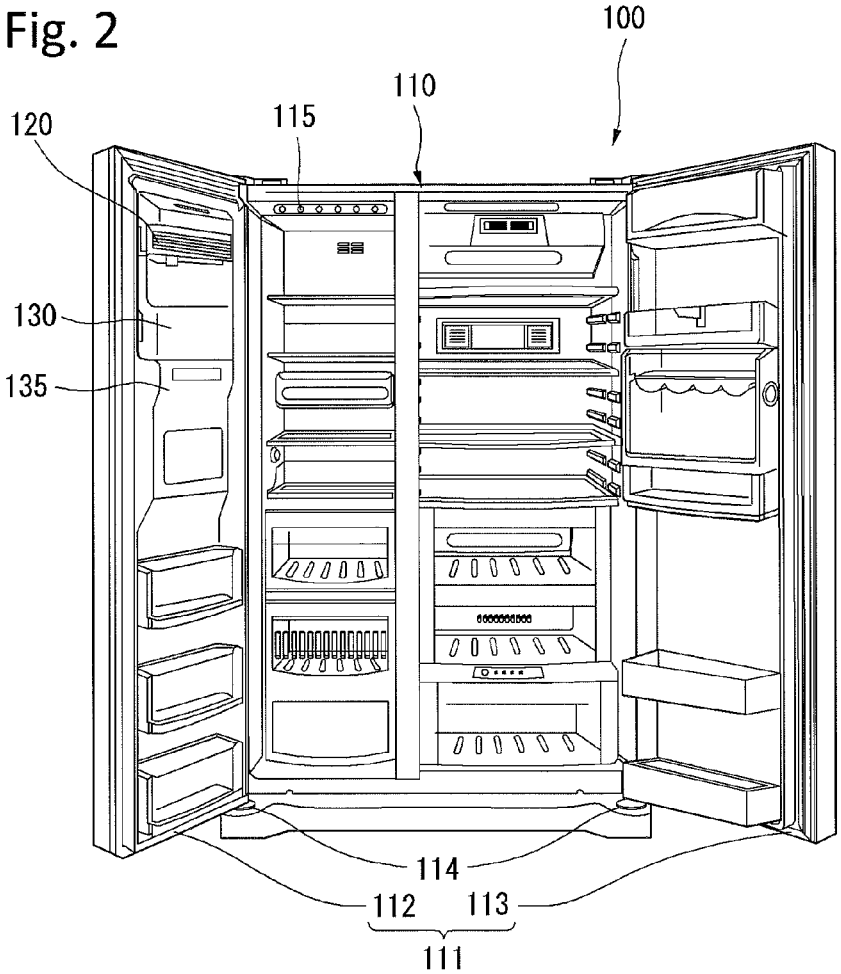
FIG. 2 shows a refrigerator according to an exemplary embodiment of the present invention, in which a door of the refrigerator stays opened.

Accordingly, there is provided herein an apparatus that prevents cold air supplied to the ice maker from flowing in the ice bank in a refrigerator where an ice making apparatus and a dispenser are arranged at a door. FIG. 2 shows a refrigerator according to an exemplary embodiment of the present invention. For simplicity of discussion, the doors are shown in the open position and the refrigerator is a side-by-side type in which a freezing compartment and a refrigerating compartment are partitioned at left and right sides, respectively.

The refrigerator 100 according to the exemplary embodiment is shaped as a rectangular parallelepiped and its outer appearance is defined by a refrigerator body 110 forming a storage space and doors 111 for opening and closing the storage space. The body 110 is partitioned into a left side and a right side, with its front side opened, and a freezing compartment and a refrigerating compartment are formed at the left and right sides, respectively. Inside the refrigerating compartment and the freezing compartment are formed a number of shelves and drawers for storing food.

The doors 111 are mounted at the front side of the body 110 and include a freezing compartment door 112 and a refrigerating compartment door 113 for selectively opening and closing the refrigerating compartment and the freezing compartment, respectively. Each of the doors 111 is rotated to the left or right of the body 110 by a hinge 114 to open and close the freezing compartment or refrigerating compartment. Each of the freezing compartment door 112 and the refrigerating compartment door 113 may be provided with a handle. At an upper part of the freezing compartment may be located a cold air hole 115 for providing cold air to the freezing compartment.

A device for users' convenience may be provided at the front side of the doors 111. For example, a home bar may be configured at the front side of the refrigerating compartment door 113 and a dispenser may be provided at the front side of the freezing compartment door 112. The dispenser allows ice cubes and water purified therein to be simply dispensed to the outside of the refrigerator.

At the rear side of the freezing compartment door 112 is provided an ice maker 120 for making ice cubes, an ice bank 130 positioned under the ice maker 120 to store ice cubes and an ice chute 135 for connecting the ice bank 130 with the dispenser to discharge ice cubes. Additionally, an ice conveying device for discharging ice cubes from the ice bank 130 to the outside is prepared under the ice bank 130.

Part of cold air discharged from the cold air hole 115 may be supplied to the ice maker 120 through an opening formed at an upper portion of the ice maker 120 and may be used for making ice cubes. In addition, two hoses may pass through the inside of the rotatable hinge 114 to supply water through the inside of the freezing compartment door 112 to the ice maker 120 and the dispenser.

Figure 3:
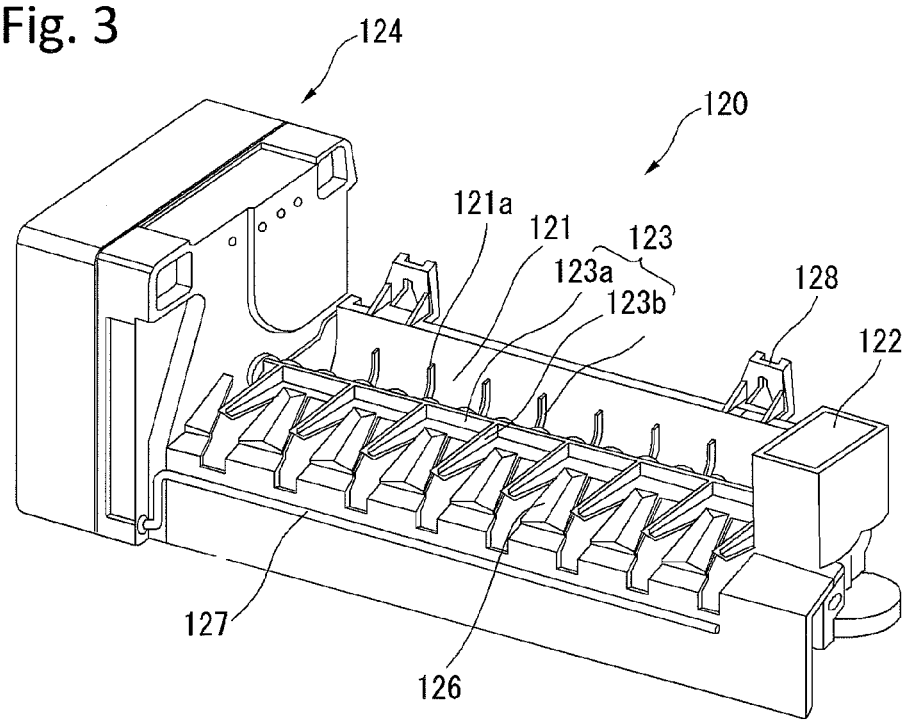
FIG. 3 is a perspective view illustrating an ice maker that is applicable to the present invention.

FIG. 3 is a perspective view illustrating an ice maker 120 according to an exemplary embodiment. In general, ice makers installed at a door of a refrigerating compartment or a freezing compartment may be classified into a heating type and a twisted type depending on methods of separating ice cubes stored in an ice tray from each other. In the twisted type, the ice tray storing ice cubes is rotated and both ends of the ice tray are then twisted in directions opposite to each other so that the ice cubes in the ice tray are dropped to the ice bank. In the heating type, a heater is prepared under the ice tray to generate heat that is then transferred to the ice cubes through the ice tray to thereby detach the surface of the ice cubes from the ice tray. An ejector is then rotated to drop the ice cubes to the ice bank.

In the twisted type, no space is required for dropping ice cubes, so this type is advantageous to minimize space; however, since the ice tray is formed of plastics, heat transfer is not good, and the speed or capacity of the ice making is poor. In the heating type, a space (between the ice maker and the cover) for dropping ice cubes is needed, resulting in the door having to be made thicker. In contrast to the twisted type, the ice tray may be formed of metal, which may accelerate ice making, and the capacity of ice making may be increased.

As seen in FIG. 3, an exemplary embodiment of the ice maker is a heating type ice maker. The ice maker 120 may include an ice tray 121 having a plurality of cells for making ice cubes having a predetermined shape, a water supplying unit 122 for supplying water to the ice tray 121, an ejector 123 for detaching ice cubes generated in the ice tray 121 from the ice tray 121, and a header 124 for operating the ejector 123 through a motor provided therein to separate the ice cubes from the ice tray 121. The ice tray 121, the water supplying unit 122, the ejector 123, and the header 124 are components for making ice cubes in the ice maker 120, and the configuration shown in FIG. 3 is merely an example, and other components may be added to the configuration or some of the components may be removed.

The ice tray 121 may be formed of a material having good thermal conductivity such as aluminum or an aluminum alloy. The ice tray 121 is shaped as a semi-cylinder and has partitioning ribs 121*a* protruding upward at the inside thereof. The partitioning ribs 121*a* are formed at a predetermined interval to form a number of cells. Water may be supplied into the cells of the ice tray 121 and may be frozen into ice cubes with the supplied water being separated by the ribs 121*a* so as to be provided cell-to-cell. At least some of the partitioning ribs 121*a* each may have a reduced height so that the supplied water may be readily moved over to other cells.

The ejector 123 is connected to a motor embedded in the header 124 located at one side of the ice tray 121. The rotational shaft 123*a* of the ejector 123 is installed to cross a middle part of the ice tray 121. A plurality of ejector pins 123*b* are provided, each of the pins 123*b* being spaced apart from each other at a predetermined interval in a direction perpendicular to the rotational shaft 123*a*. Each of the ejector pins 123*b* is provided for a corresponding one of the cells partitioned by the plurality of partitioning ribs 121*a*. As the rotational shaft 123*a* rotates, the ejector pins 123*b* may lift the ice cubes from their respective cells.

A heater 125 (shown in FIG. 5A) is electrically connected to a power source and is attached to a lower surface of the ice tray 121. The heater 125 heats the surface of the ice tray 121 for a short time to melt the surface of the ice cubes attached to the inside of the ice tray 121 so that the ice cubes may be easily detached from the ice tray 121.

A sliding bar 126 may be formed that is extended from a front side of the ice tray 121 approximately up to a position near the rotational shaft 123*a* of the ejector 123 so as to cover part of the opened upper side of the ice tray 121. The sliding bar 126 prevents the ice cubes lifted by the ejector 123 from going back to the inside of the ice tray 121 so that the ice cubes are guided to the front side of the ice tray 121 of the ice maker 120 and are then slid towards the ice bank 130 thereunder. In addition, the sliding bar 126 may prevent the water contained in the ice tray 121 from overflowing into the ice bank 130 due to an impact that occurs when the freezing compartment door 112 is opened or closed. The sliding bar 126 may be formed of a material that may be cut and elastically deformed so that the ejector pins 123*b* for lifting ice cubes may be rotated.

The ice maker 120 has a full ice sensing arm 127 installed to measure the amount of the ice cubes filled in the ice bank 130. The full ice sensing arm 127 is connected to the motor of the header 124 and is rotated, while measuring the amount of the ice cubes filled in the ice bank 130, so that the ice bank 130 remains filled with a predetermined amount of ice cubes.

The header 124 has a control module, a motor, a gear and the like. The header 124 rotates the full ice sensing arm 127 at a predetermined time interval to verify whether a predetermined amount of ice cubes are filled in the ice bank 130 and. if the ice bank 130 is not filled with ice cubes, drives the ejector 123 so that the ice cubes contained in the ice tray 121 may be discharged to the ice bank 130 and water may be supplied to the ice tray 121 through the water supplying unit 122.

A connecting unit 128 for fastening the ice maker 120 to a wall surface of the freezing compartment door 112 (or refrigerating compartment door) is provided at a back side of the ice tray 121. A connecting protrusion formed at the freezing compartment door 112 may be inserted into a hole formed at the connecting unit 128 so that the ice maker 120 may be fixed to the freezing compartment door 112.

Figure 4A:
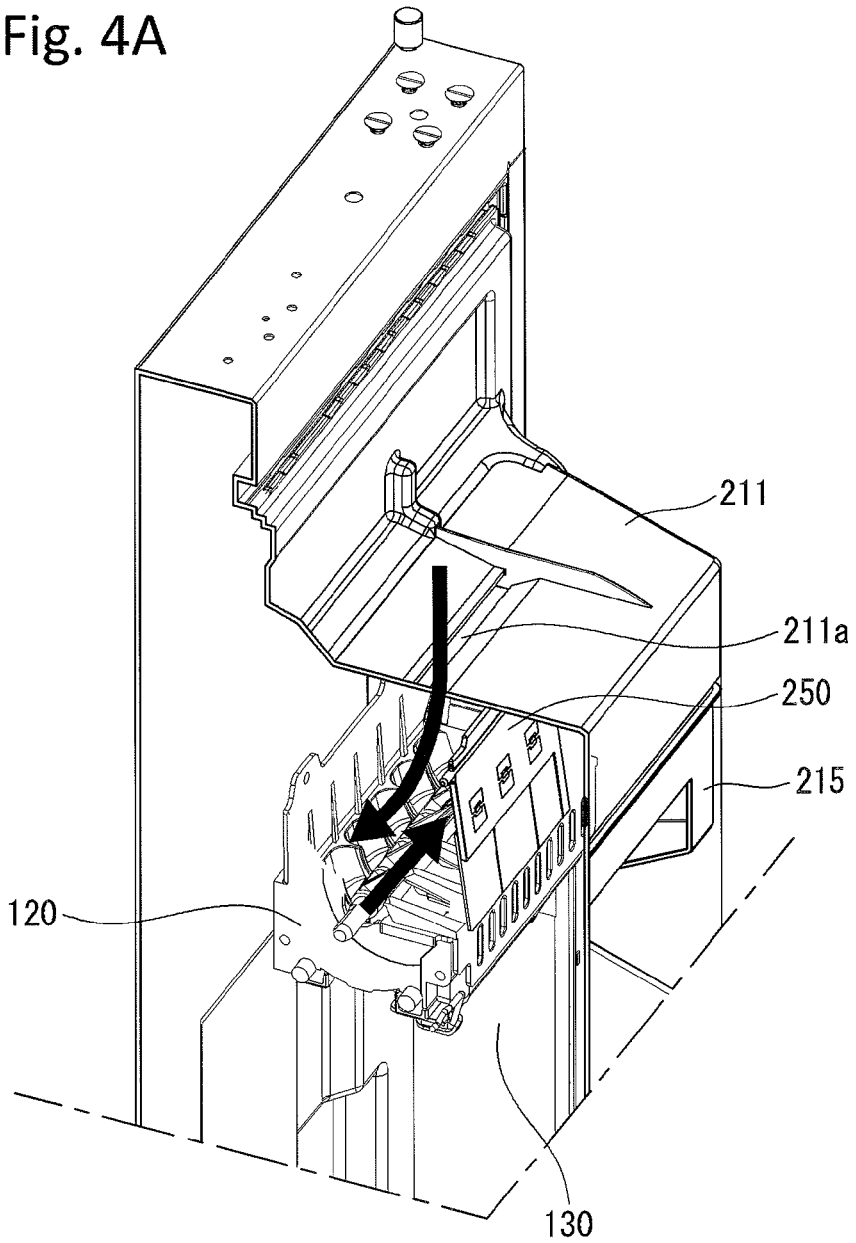
FIG. 4A shows a state where an ice shutter according to an embodiment of the present invention stops cold air from flowing into an ice bank.
Figure 4B:
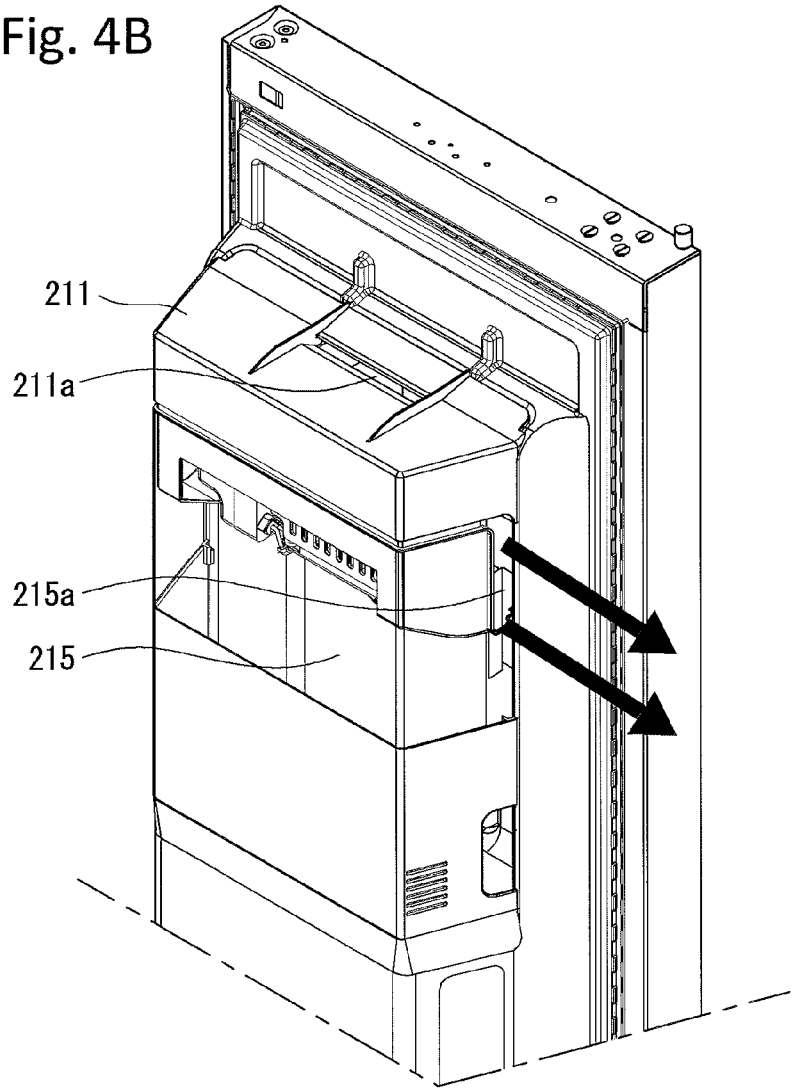
FIG. 4B shows a state where cold air flowing into an ice maker detours to a freezing compartment by an ice shutter according to an embodiment of the present invention.

FIG. 4A shows a state where an ice shutter according to an embodiment of the present invention stops cold air from flowing into an ice bank and FIG. 4B shows a state where cold air flowing into an ice maker is redirected to a freezing compartment by an ice shutter according to an exemplary embodiment. As seen in FIGS. 4A and 4B, an upper cover 211 is located at an upper portion of the ice maker 120 and a front cover 215 is located at the front side of the ice maker 120 and the ice bank 130 to isolate or heat block the ice maker 120 and the ice bank 130 from the freezing compartment. As noted previously, the ice maker 120 and the ice bank 130 are parts of an ice making apparatus provided in the freezing compartment door 112, At an upper part of the upper cover 211 is formed an inlet opening 211*a* for receiving cold air discharged from the cold air hole 115 located at an upper part of the freezing compartment. An upper surface of the upper part may be include a guiding rib for guiding the cold air discharged from the cold air hole 115 into the inlet opening 211*a*. The inlet opening 211*a* may be located at a position that is closer to an inner surface of the freezing compartment door 112 than to the front surface or front portion of the ice tray 121 of the ice maker 120.

An ice shutter 250 for preventing cold air flowing into the ice maker 120 through the inlet opening 211*a* from being introduced into the ice bank 130 is hung from a lower surface of the upper part of the upper cover 211. The ice shutter 250 is hung at a position that is further away from the inner surface of the freezing compartment door 112 (or closer to the front cover 215) than from the inlet opening 211*a* and that is closer to the inner surface of the freezing compartment door 112 (or further away from the front cover 215) than to the front surface of the ice tray 121 of the ice maker 120. For example, the ice shutter 250 is hung between the inlet opening 211*a* and a front surface of the ice tray 123 (see FIG. 5A).

The ice shutter 250 has a width corresponding to a width (length in horizontal direction) of the ice tray 121 and has an extended length so that an end thereof, which is positioned opposite to a portion which is rotatably connected to the upper cover 211, is hung over the front surface of the ice tray 121.

As shown in FIG. 4B, an outlet opening 215*a* is formed at a side surface that is positioned at a portion close to the freezing compartment (a portion close to the rotational shaft of the freezing compartment door) of the front cover 215, with the freezing compartment door 112 staying opened, so that cold air flowing in through the inlet opening 215*a* freezes the water contained in the ice tray 121 and is then discharged into the inside of the freezing compartment through the outlet opening 215*a*. The outlet opening 215*a* may be formed at an upper side closer to the upper cover 211 with respect to an upper and lower direction, at an inside closer to the front surface of the freezing compartment door 112 (further away from the front cover) with respect to a front and rear direction (direction of thickness of the freezing compartment door) and at a side surface of the front cover 215.

As such, cold air introduced into the ice maker 120 is blocked by the ice shutter 250. Thus, the cold air does not flow into the ice bank 130 but is rather discharged away through the outlet opening 215*a*. Therefore, ice cubes retained in the ice bank 130 are prevented from sticking to each other and the capacity of ice making is enhanced. According to an experimental result, after the ice shutter 250 is installed, the capacity of ice making has been improved by about 15%.

While, in the exemplary embodiment shown in FIGS. 4A and 4B, the upper cover 211 and the front cover 215 are separated from each other to block heat between the freezing compartment and the ice making apparatus (ice maker and ice bank), the arrangement is not limited thereto. For example, the upper cover 211 and the front cover 215 may be formed as a single cover, and in such case, the corresponding cover has an inlet opening at its upper side and an outlet opening at its side surface.

Figure 5A:
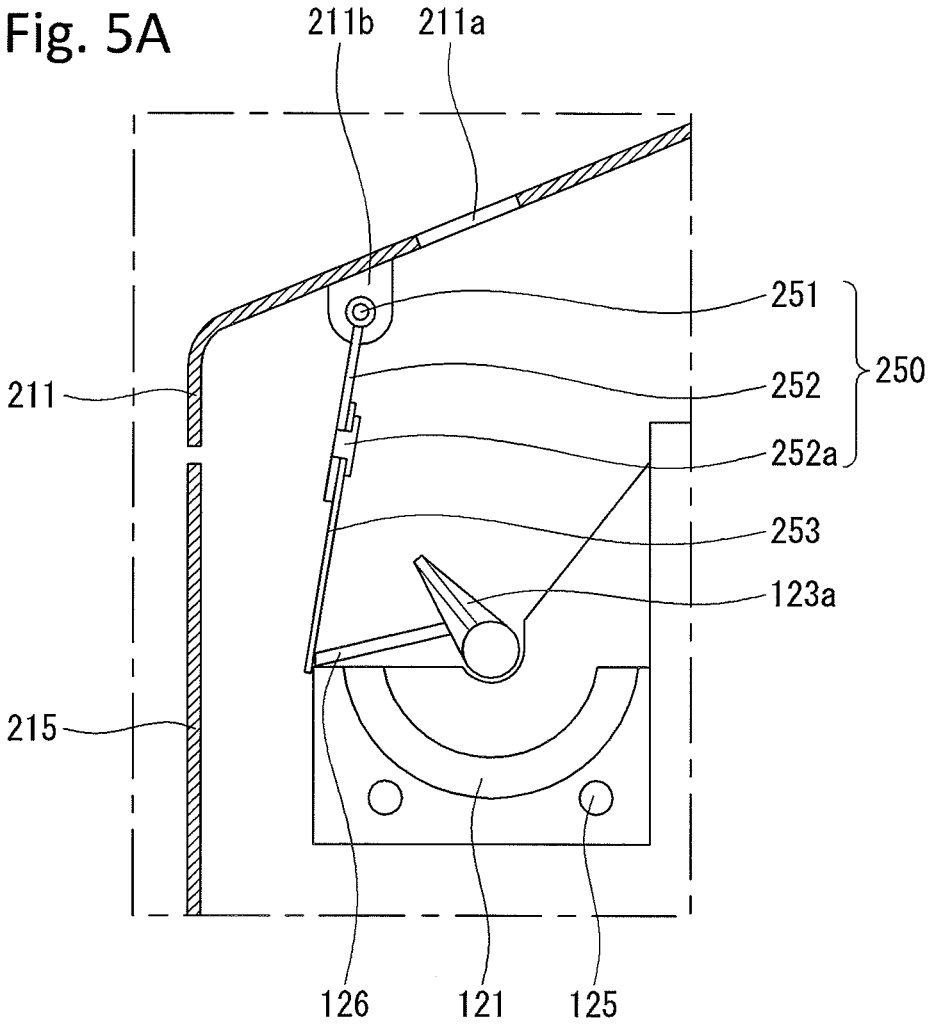
FIGS. 5A and 5B show a state in which an ice shutter is connected to an upper cover according to an embodiment of the present invention.
Figure 5B:
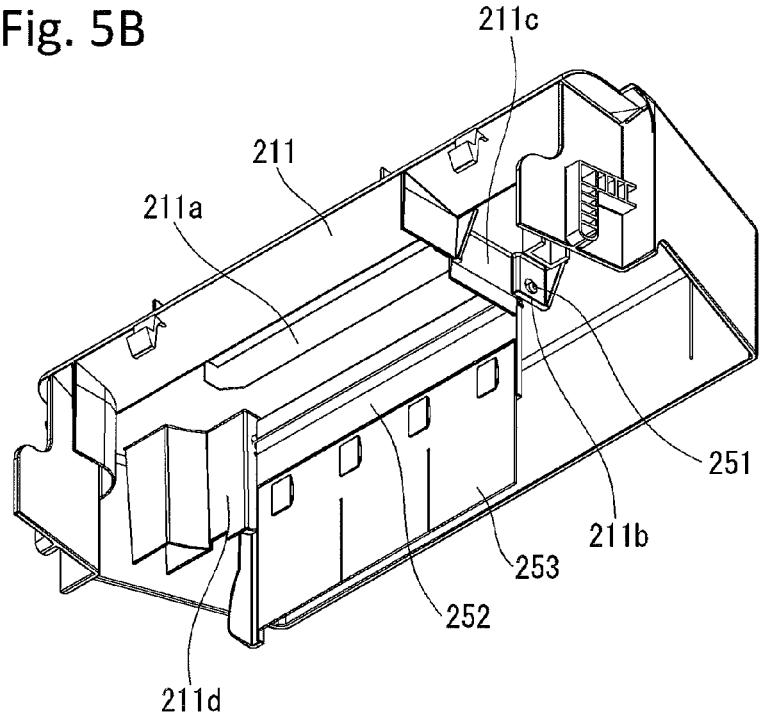

FIGS. 5A and 5B show a state in which an ice shutter 250 is connected to an upper cover 211 according to an exemplary embodiment. FIG. 5A is a cross-sectional view of the ice shutter 250 and the upper cover 211 while FIG. 5B is a view obtained when the ice shutter 250 and the upper cover 211 are viewed upwards from the ice maker 120.

As seen in FIG. 5A, the ice shutter 250 is connected to a shutter rotational shaft supporting unit 211*b* formed at a lower surface of the upper cover 211 by a shutter rotational shaft 251 located at an end thereof and may rotate about the shutter rotational shaft 251. The shutter rotational shaft 251 is positioned parallel with the rotational shaft 123*a* of the ejector 123 of the ice maker 120 such that the shutter rotational shaft 251 and the ice shutter 250 may be parallel with the front surface of the ice tray 121 (since it is parallel with the rotational shaft 123*a* of the ejector).

Because the shutter rotational shaft 251 is connected to the upper cover 211 at a position close to the front surface of the freezing compartment door 112 (far away from the front cover), the ice shutter 250 sags downward by its own weight and is thus brought in tight linear contact with an edge of the front surface of the ice tray 121 so that air cannot flow between the ice shutter 250 and the ice tray 121.

The ice shutter 250 may include a shutter upper portion 252 and a shutter lower portion 253. The shutter upper portion 252 and the shutter lower portion 253 may be coupled with each other by a plurality of shutter protrusions 252*a* and a plurality of shutter openings 253*a*. The shutter upper portion 252 may be formed of injection molded plastic. The shutter lower portion 253 may be formed of a flexible material such as silicone or rubber. The silicone used for the shutter lower portion 253 does not stick to ice cubes, injection-molded plastic, or metal and is not prone to be cured at a lower temperature and is not easily deformed due to a change in temperature.

As seen in FIG. 5B, members are provided that allow the upper cover 211 to be coupled with the freezing compartment door 112 so that the upper cover 211 is placed over the ice maker 120 and the front cover 215. In addition, ribs are protruded from a lower surface of the upper cover 211 to allow cold air flowing in through the inlet opening 211*a* to be supplied only to the ice tray 121 and to be blocked from flowing into any other places. Such ribs may be formed at the positions corresponding to the parts of the ice maker 120 and to the shapes corresponding to the parts of the ice maker 120. For example, a rib 211*c* protruding from a lower surface of the upper cover 211 is formed to correspond to the shape and position of the header 124 of the ice maker 120 and a rib 211*d* is formed to correspond to the water supplying unit 122 of the ice maker 120. Since the ice shutter 250 has a width corresponding to the ice tray 121 of the ice maker 120, it extends in the horizontal direction up to the rib 211*c* that is protruded corresponding in shape and position to the header 124 of the ice maker 120.

Figure 6A:
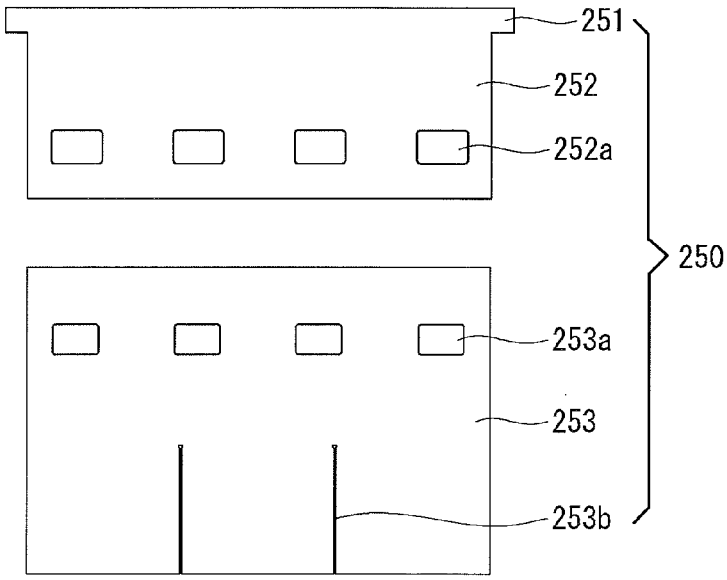
FIG. 6A is an exploded plan view of an ice shutter according to an embodiment of the present invention.

The ice shutter 250 may further a shutter side portion 254 that extends in a vertical direction (longitudinal direction of the ice shutter) from the upper cover 211 at an opposite side of the header 124 of the ice maker 120 (see FIG. 6A). The shutter side portion 254 forms a flat surface in a direction perpendicular to a flat surface formed by the ice shutter 250 and is formed at a space where the front surface of the ice maker 120 does not contact the flat surface of the ice shutter 250 (the flat surface formed by the shutter upper portion 252 and the shutter lower portion 253), thus preventing cold air flowing into the ice maker 120 from being discharged to the ice bank 130 through the space while guiding the cold air to be discharged through the outlet opening 215*a* formed at the side surface of the front cover 215.

Figure 6B:
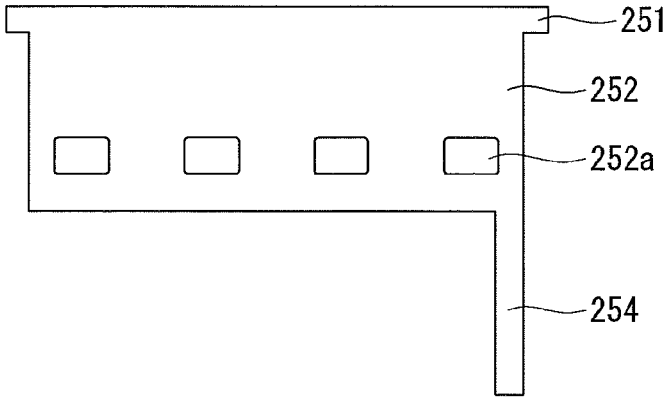
FIG. 6B is a plan view of an alternative shutter upper portion.

FIG. 6A is an exploded plan view of an ice shutter 250 according to an exemplary embodiment. As seen in FIG. 6A, the shutter rotational shaft 251 and the shutter upper portion 252 may be integrated to be a single part and the shutter rotational shaft 251 may protrude from both sides of an upper portion of the shutter upper portion 252. Further, the shutter side portion 254 may be integrated with the shutter upper portion 252 into a single part (FIG. 6B) so that it may be injection-molded into a plastic body.

A plurality of shutter protrusions 252*a* is formed at the shutter upper portion 252. The shutter protrusions 252*a* may be inserted into a plurality of shutter openings 253*a* formed at corresponding positions of the shutter lower portion 253 so that the shutter upper portion 252 may be coupled with the shutter lower portion 253. The horizontal length (length in the width direction) of the shutter opening 253*a* is substantially the same or slightly smaller than the horizontal length of the shutter protrusion 252*a*, but the vertical length of the shutter opening 253*a* may be smaller than the vertical length of the shutter protrusion 252*a*, which may be advantageous from the point of view of a tight coupling between the shutter upper portion 252 and the shutter lower portion 253.

A plurality of shutter cuts 253*b* may be formed at the shutter lower portion 253 in a vertical direction. The plurality of shutter cuts 253*b* allows the ice cubes formed in the ice tray 121 to be less resistant against the ice shutter 250, when lifted, as the ejector 123 rotates and then slid along the sliding bar 126 down to the ice bank 130.

Figure 7A:
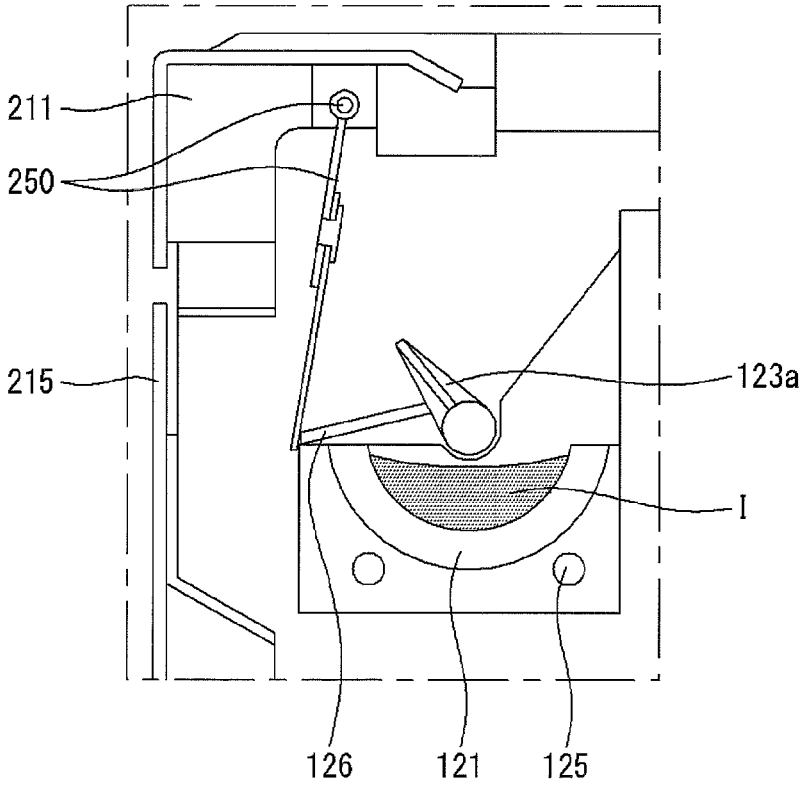
FIG. 7A shows a state in which an ice shutter blocks cold air from flowing into an ice bank according to an embodiment of the present invention.
Figure 7B:
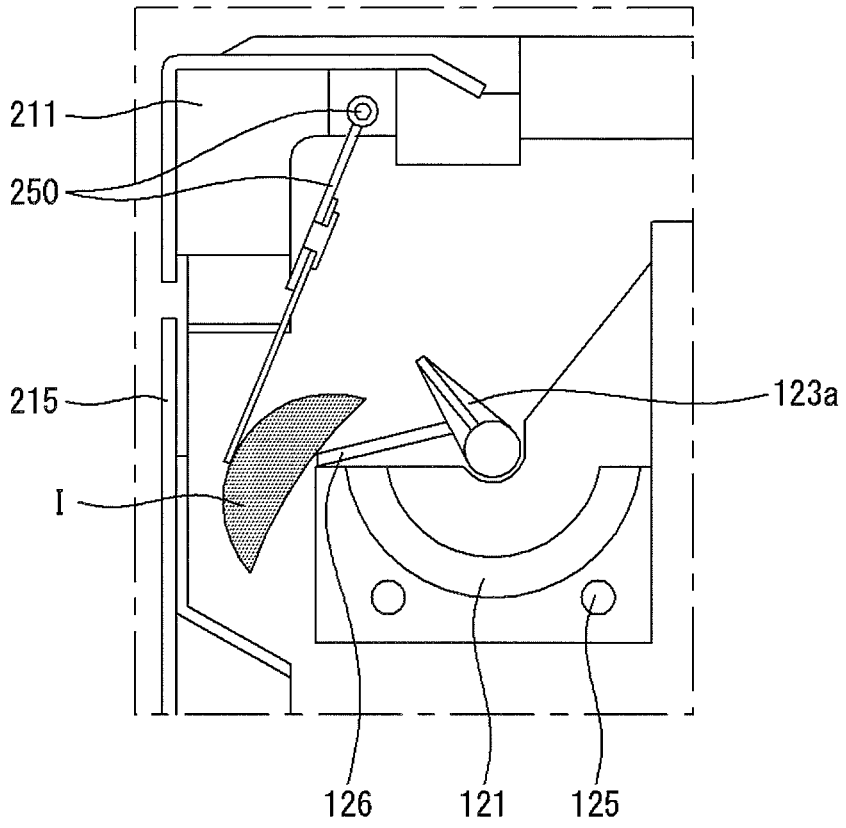
FIG. 7B shows a state in which ice cubes made in an ice maker are carried to an ice bank while the ice shutter rotates according to an embodiment of the present invention.

FIG. 7A shows a state in which an ice shutter blocks cold air from flowing into an ice bank according to an exemplary embodiment and FIG. 7B shows a state in which ice cubes made in an ice maker are carried to an ice bank while the ice shutter rotates according to an exemplary embodiment. In addition, both FIGS. 7A and 7B show cross sections of an ice making apparatus installed at a freezing compartment door 112 according to an exemplary embodiment where the front surface of the freezing compartment door 112 is positioned at a right side.

Because the shutter rotational shaft 251 of the ice shutter 250 is positioned closer to the front surface of the freezing compartment door 112 (further away from the front cover) than to the front surface of the ice tray 121, the ice shutter 250 sags downwards due to its own weight and hangs over the front surface of the ice tray 121, as seen in FIG. 7A. That is, when the ice shutter 250 remains closed, an end of the shutter lower portion 253 leans against the front surface of the ice tray 121 and thus blocks the cold air flowing into the ice maker 120 from being introduced to the ice bank 130.

If the full ice sensing arm 127 rotates and determines that the ice bank 130 is not filled with ice cubes, the ejector 123 rotates to discharge the ice cube(s) I from the ice tray 121 to the ice bank 130. Each of the ejector pins 123*b* is rotated to lift an ice cube I from a corresponding cell in the ice tray 121, and the ice cube I slides along the sliding bar 126, pushes the shutter lower portion 253, and drops to the ice bank 130 through a space between the front surface of the ice tray 121 and the front cover 215. When the ice cube I sliding along the sliding bar 126 pushes the shutter lower portion 253, the ice shutter 250 pivots towards the front cover 215 with respect to the shutter rotational shaft 251. After the ice cube(s) I drop to the ice bank 130, the ice shutter 250 rotates back to the lower side due to its own weight so that the shutter lower portion 253 is rendered to hang over the front surface of the ice tray 121, thus forming a closed state.

Because the front surface of the header 124 protrudes further than the front surface of the ice tray 121 does, a side surface of the header 124 (a surface facing the ice tray 121) and the ice shutter 250 form a closed space, and cold air supplied to a space over the ice tray 121 flows in an opposite direction of the header 124 (a direction toward where the water supplying unit 122 is placed) and is then discharged to the freezing compartment through the outlet opening 215*a* formed at the front cover 215.

When ice cubes are carried from the ice tray 121 to the ice bank 130, the ice shutter 250 is rotated open by the ice cubes, and cold air in the ice maker 120, together with the ice cubes, is introduced into the ice bank 130. Accordingly, right before the ejector 123 is operated, the operation of a cooling fan discharging the cold air to the freezing compartment through the cold air hole 115 may be temporarily stopped.

In the above-described exemplary embodiment, because the shutter upper portion 252 may be formed of injection-molded plastic while the shutter lower portion 253 formed of silicone, situations may arise where the shutter rotational shaft 251 and the shutter rotational shaft supporting unit 211*b* are frozen, possibly because of spattered water, causing the ice shutter 250 to be not rotated but to remain stationary. In this situation, while the ice shutter 250 remains opened (in a rotated state), as shown in FIG. 7B, the silicone of the shutter lower portion 253 may still bend downwards or in a vertical direction due to its own weight, thus leaving less cold air being introduced into the ice bank 130. Further, in case the ice shutter 250 remains closed, as shown in FIG. 7A, ice cubes slide along the sliding bar 126, push the flexible, silicone-based shutter lower portion 253, and may drop to the ice bank 130 through a space between the front surface of the ice tray 121 and the front cover 215.

The shutter rotational shaft 251 and the shutter rotational shaft supporting unit 211*b* have a low chance of being left at a fixed position due to freezing. Thus, the ice shutter 250 may be formed as a single shutter rather than being divided into the shutter upper portion 252 and the shutter lower portion 253, and in such case, the single shutter may be formed of injection-molded plastic or silicone.

Normally, an impact that occurs when the freezing compartment door 112 is opened or closed may cause water in the ice tray 121 to spatter into the ice bank 130; however, due to the presence of the ice shutter 250, the shutter 250 may prevent the water from being spattered into the ice bank 130.

While a side-by-side type refrigerator has been described above, the present invention is not limited thereto and may be rather applicable to any other types of refrigerators in which a cooling apparatus and a dispenser are provided at a door and cold air is supplied from an upper portion to the cooling apparatus. The above-described embodiments of the present invention are provided merely as examples. It will be understood by those of ordinary skill that various modifications or variations may be made thereto without departing from the scope or technical spirit of the present invention.

What is claimed is:

1. A refrigerator comprising:

a main body including a compartment;

an ice bank configured to store ice cubes;

an ice maker configured to generate ice cubes and to move the ice cubes to the ice bank, the ice maker including an ice tray;

a cover assembly configured to isolate the ice bank and the ice maker from the compartment, the cover assembly including:

a first cover disposed above the ice maker and having a first opening to introduce cold air to the ice maker; and a second cover disposed below the first cover to cover front and side portions of the ice maker and the ice bank, the second cover having a second opening at a side surface thereof to discharge the cold air introduced through the first opening; and an ice shutter rotatably coupled to the first cover by a shutter rotational shaft and disposed in a space established by the first and second covers, the ice shutter configured to prevent cold air introduced through the first opening from being introduced into the ice bank.

2. The refrigerator of claim 1, wherein the ice shutter is configured to be rotated when the ice cubes generated in the ice maker are carried to the ice bank.

3. The refrigerator of claim 1, wherein the ice shutter includes a shutter upper portion formed of injection-molded plastic and a shutter lower portion formed of silicone.

4. The refrigerator of claim 3, wherein part of the shutter lower portion is cut in a vertical direction.

5. The refrigerator of claim 3, wherein the ice maker includes:

an ejector configured to separate ice cubes from the ice tray; and a header having a motor to rotate the ejector, and wherein the ice shutter further includes a shutter side portion that extends in a vertical direction from an upper part of the first cover at an opposite side of the header.

6. The refrigerator of claim 5, wherein the shutter side portion is formed of injection-molded plastic, and wherein the shutter side portion forms a flat surface in a direction perpendicular to a flat surface formed by the shutter upper portion and the shutter lower portion.

7. The refrigerator of claim 1, wherein the ice shutter is connected to a lower surface of an upper part of the cover through a shutter rotational shaft, the ice shutter being rotatable about a shutter rotational axis defined by the shutter rotational shaft.

8. The refrigerator of claim 7, wherein the first opening, the shutter rotational shaft, and a front portion of the ice tray are further away from a front surface of the second cover in order thereof.

9. The refrigerator of claim 7, wherein the ice shutter has a width corresponding to a horizontal length of the ice tray.

10. The refrigerator of claim 7, wherein a lower end of the ice shutter extends to contact a front portion of the ice tray.

11. The refrigerator of claim 1, wherein the ice maker includes:

an ejector configured to separate ice cubes from the ice tray; and a header having a motor to rotate the ejector.

12. The refrigerator of claim 1, wherein the second opening is formed at a position closer to a rear end of the side surface of the second cover than a front end of the side surface of the second cover.

13. The refrigerator of claim 1, wherein one or more ribs protrude from a lower surface of an upper part of the first cover to correspond in position and shape to parts of the ice maker.

14. The refrigerator of claim 1, wherein one or more guiding ribs are formed at an upper surface of an upper part of the first cover to guide cold air discharged from a cold air hole of the compartment into the first opening.

15. A refrigerator comprising:

a main body including a compartment;

an ice bank configured to store ice cubes;

an ice maker configured to generate ice cubes and to move the ice cubes to the ice bank, the ice maker including an ice tray;

a cover configured to isolate the ice bank and the ice maker form the compartment, the cover including a first opening; and an ice shutter configured to prevent cold air flowing through the first opening of the cover into the ice maker from being introduced into the ice bank, wherein the ice shutter includes:

a shutter upper portion formed to be rigid; and a shutter lower portion formed to be flexible.

16. The refrigerator of claim 15, wherein the shutter upper portion is formed of injection-molded plastic, and the shutter lower portion is formed of silicone.

17. The refrigerator of claim 15, wherein part of the shutter lower portion is cut in a vertical direction.

18. The refrigerator of claim 15, wherein the ice maker includes:

an ejector configured to separate ice cubes from the ice tray; and a header having a motor to rotate the ejector, wherein the ice shutter further includes a shutter side portion that extends in a vertical direction from an upper part of the cover at an opposite side of the header.

19. The refrigerator of claim 18, wherein the shutter side portion is formed of injection-molded plastic, and wherein the shutter side portion forms a flat surface in a direction perpendicular to a flat surface formed by the shutter upper portion and the shutter lower portion.

20. A refrigerator comprising:

a main body including a compartment;

an ice bank configured to store ice cubes;

an ice maker configured to generate ice cubes and to move the ice cubes to the ice bank, the ice maker including an ice tray;

a cover configured to isolate the ice bank and the ice maker form the compartment, the cover including a first opening; and an ice shutter configured to prevent cold air flowing through the first opening of the cover into the ice maker from being introduced into the ice bank, wherein one or more ribs protrude from a lower surface of an upper part of the cover to correspond in position and shape to parts of the ice maker that are placed under the cover.

21. A refrigerator comprising:

a main body including a compartment;

an ice bank configured to store ice cubes;

an ice maker configured to generate ice cubes and to move the ice cubes to the ice bank, the ice maker including an ice tray;

a cover configured to isolate the ice bank and the ice maker form the compartment, the cover including a first opening; and an ice shutter configured to prevent cold air flowing through the first opening of the cover into the ice maker from being introduced into the ice bank, wherein one or more guiding ribs are formed at an upper surface of an upper part of the cover to guide cold air discharged from a cold air hole of the compartment so as to be introduced into the first opening.

* * * * *